US009283661B2

(12) United States Patent
Cummings et al.

(10) Patent No.: US 9,283,661 B2
(45) Date of Patent: Mar. 15, 2016

(54) IMPACT SOCKET

(71) Applicant: Lowell Corporation, West Boylston, MA (US)

(72) Inventors: David S. Cummings, Princeton, MA (US); Derek Silsby, Worcester, MA (US); Paul Carnes, North Dartmouth, MA (US)

(73) Assignee: Lowell Corporation, W. Boylston, MA (US)

( * ) Notice: Subject to any disclaimer, the term of this patent is extended or adjusted under 35 U.S.C. 154(b) by 95 days.

(21) Appl. No.: 14/046,473

(22) Filed: Oct. 4, 2013

(65) Prior Publication Data

US 2014/0096654 A1 Apr. 10, 2014

Related U.S. Application Data

(60) Provisional application No. 61/710,297, filed on Oct. 5, 2012.

(51) Int. Cl.

| | |
|---|---|
| ***B25B 13/00*** | (2006.01) |
| ***B25B 13/06*** | (2006.01) |
| ***B25B 19/00*** | (2006.01) |
| ***B25B 13/10*** | (2006.01) |
| ***B25B 21/02*** | (2006.01) |

(52) U.S. Cl.

CPC ..... *B25B 13/06* (2013.01); *B25B 13/102* (2013.01); *B25B 19/00* (2013.01); *B25B 21/02* (2013.01)

(58) Field of Classification Search

CPC ..... B25B 13/06; B25B 13/56; B25B 13/04; B25B 13/065; B25B 13/102; B25B 13/105; B25B 19/00; B25B 21/00; B25B 21/02; B25B 23/0007

USPC ..... 81/124.4, 124.5, 185, 186, 125.1, 81/124.6, 121.1, 125

See application file for complete search history.

(56) References Cited

U.S. PATENT DOCUMENTS

| | | | | |
|---|---|---|---|---|
| 1,626,730 | A * | 5/1927 | Haynes | 81/185 |
| 3,187,610 | A * | 6/1965 | Russman | 81/185 |
| 4,768,405 | A * | 9/1988 | Nickipuck | 81/177.85 |
| 6,354,176 | B1 * | 3/2002 | Nordlin | 81/124.4 |
| 7,654,175 | B2 * | 2/2010 | Hamon | 81/125 |

(Continued)

OTHER PUBLICATIONS

Specialised Force, Pty. Ltd., "NGK Ratchet Cutter—NGK Ratchet Spanner," NGK Brochure.

(Continued)

*Primary Examiner* — Monica Carter
*Assistant Examiner* — Melanie Alexander
(74) *Attorney, Agent, or Firm* — Dingman, McInnes & McLane, LLP

(57) ABSTRACT

An impact socket includes a socket body having a first end configured to mount to a drive shaft of an impact wrench and an opposing second end, the socket body defining at least one socket body fastener driving structure at the second end. The impact socket includes a collar assembly carried by the socket body, the collar assembly defining at least one collar assembly fastener driving structure. The collar assembly is configured to move linearly between (i) a first position relative to the socket body where a distal end of the collar assembly extends beyond a distal end of the socket body and (ii) a second position where the distal end is disposed at least equidistant to the second end of the socket body.

14 Claims, 9 Drawing Sheets

(56) References Cited

U.S. PATENT DOCUMENTS

| | | | | |
|---|---|---|---|---|
| 2001/0006014 | A1* | 7/2001 | Cowart et al. | 81/437 |
| 2008/0041193 | A1* | 2/2008 | Baker | 81/124.6 |

OTHER PUBLICATIONS

Greenlee Textron, Inc., "NR1 & NR2—Nut Runners," Greenlee Nut Runner Data Sheet, Dec. 2005.

* cited by examiner

IMPACT SOCKET

RELATED APPLICATIONS

This patent application claims the benefit of U.S. Provisional Application No. 61/710,297, filed on Oct. 5, 2012, entitled, "Impact Socket," the contents and teachings of which are hereby incorporated by reference in their entirety.

BACKGROUND

Conventional impact wrenches or impact guns are configured to deliver a relatively high output torque to associated impact sockets with minimum exertion by the user. For example, one end of a conventional impact socket is directly mounted to the drive shaft of an impact wrench while the opposing end of the impact socket is configured to engage a nut or bolt head. In use, pressurized air rotates a drive shaft of the impact wrench and provides a substantially precise output torque to the nut or bolt head via the impact socket.

SUMMARY

Conventional impact sockets suffer from a variety of deficiencies. For example, conventional impact sockets are sized and shaped to drive correspondingly-sized nuts or bolts. Accordingly, a one inch impact socket is configured to drive a one inch nut or bolt head while a 1⅛ inch impact socket is configured to drive a 1⅛ inch nut or bolt head.

In certain cases, an operator can encounter a variety of differently-sized nuts or bolt heads at a work site, such as fasteners having one inch and 1⅛ inch nuts or bolt heads. With conventional impact wrenches, operators are required to carry a relatively large number of impact sockets to a work site to accommodate a potentially wide variety of nut or bolt head sizes that can be encountered. Accordingly, there is an increased risk that the operator can lose or misplace one or more impact sockets of a set. Additionally, because conventional impact sockets are configured to drive only a single, correspondingly sized fastener, the operator can be required to repeatedly remove and attach appropriately sized impact sockets relative to the impact wrench over the course of a single job. This can reduce the operator's efficiency at the job site and can increase the overall costs in completing a task.

By contrast to conventional impact sockets, embodiments of the present innovation relate to an impact socket having a first end configured to mount to a drive shaft of an impact wrench and an opposing second end having a set of fastener driving structures. For example, the second end of the impact socket includes a collar assembly that defines one or more fastener driving structures at its distal end. The collar assembly is configured to move linearly between a first position and second position relative to a socket body of the impact socket. In the first position, the distal end of the collar assembly can extend beyond a distal end of the socket body such that a user can use the collar assembly fastener driving structure for driving a correspondingly sized nut or bolt head. In the second position, the distal end of the collar assembly is disposed proximal to the distal end of the socket body which also defines at least one fastener driving structure. With such positioning, the collar assembly exposes the distal end of the socket body and allows the user to utilize the socket body fastener driving structure for driving a correspondingly sized nut or bolt head.

Accordingly, the impact socket provides at least two distinct fastener driving structures at a single end. This configuration of the impact socket allows the user to select one of the fastener driving structures to drive a fastener without being required to remove the impact socket from the impact wrench. Accordingly, the configuration of the impact socket can improve operator efficiency and can reduce the risk of loss.

In one arrangement, an impact socket includes a socket body having a first end configured to mount to a drive shaft of an impact wrench and an opposing second end, the socket body defining at least one socket body fastener driving structure at the second end. The impact socket includes a collar assembly carried by the socket body, the collar assembly defining at least one collar assembly fastener driving structure. The collar assembly is configured to move linearly between (i) a first position relative to the socket body where a distal end of the collar assembly extends beyond a distal end of the socket body and (ii) a second position where the distal end is disposed at least equidistant to the second end of the socket body, the second end of the socket body defining a third fastener driving structure.

In one arrangement, an impact socket includes a socket body having a first end configured to mount to a drive shaft of an impact wrench and an opposing second end, the socket body defining at least one socket body fastener driving structure at the second end. The impact socket includes a collar assembly carried by the socket body, the collar assembly defining at least one collar assembly fastener driving structure. The collar assembly configured to be selectively secured to the socket body at (i) a first position relative to the socket body where a distal end of the collar assembly extends beyond a distal end of the socket body and (ii) a second position where the distal end is disposed at least equidistant to the second end of the socket body.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Figure 1:
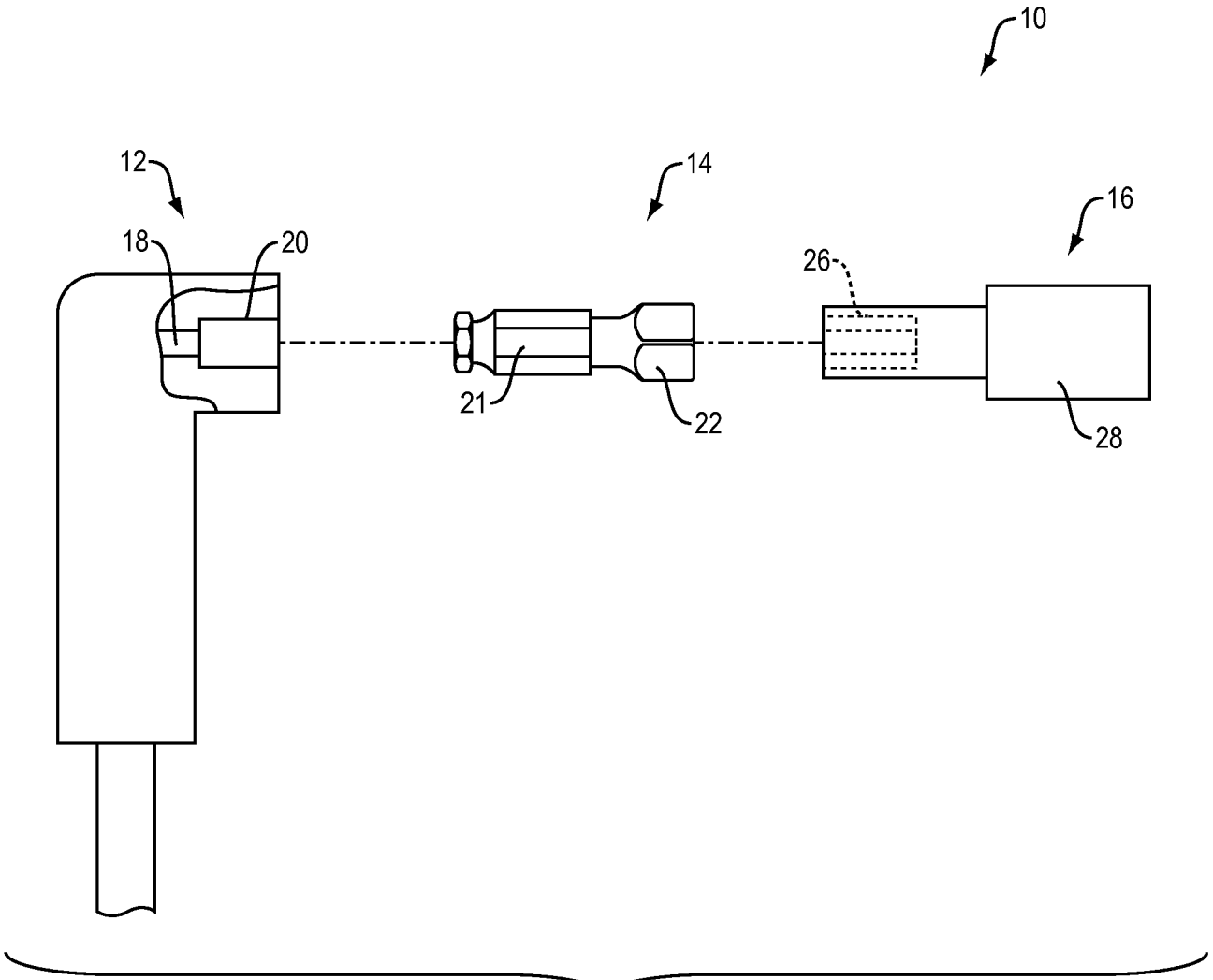
FIG. 1 illustrates a schematic representation of an exploded view of an impact wrench assembly, according to one arrangement.

FIG. 1 illustrates an example schematic representation of an exploded view of an impact wrench assembly 10. In one arrangement, the impact wrench assembly 10 includes an impact wrench 12, an adaptor 14, and an impact socket 16. The adaptor 14 is configured to couple a drive shaft 18 of the impact wrench 12 to the impact socket 16. In one arrangement, the drive shaft 18 includes a chuck 20 configured to receive a first end 24 of the adaptor 14 and secure the adaptor 14 to the impact wrench 12. A second end 22 of the adaptor 14 is configured to be inserted within a chamber 26 defined by the impact socket 16 and secured to the impact socket 16 via a fastening mechanism (not shown), such as a ball detent assembly, pin, or position lock for example. In use, a user operates the impact wrench 12 to cause the drive shaft 18 to rotate the impact socket 16 about a longitudinal axis 28.

In one arrangement, the impact wrench 12 generates a relatively large amount of torque on the impact socket 16. To withstand the relatively large amount of torque, the impact socket 16 is manufactured from a relatively strong material, such as a 4100/4300 high carbon alloy steel, for example.

FIGS. 2-6 illustrate an example of the impact socket 16 shown schematically in FIG. 1. As shown, the impact socket 16 includes a socket body 30 and a collar assembly 32 disposed thereon.

The socket body 30 includes a first end 33 configured to mount to a drive shaft 18 of an impact wrench 12 and an opposing second end 34 configured to drive a fastener. As indicated above, the first end 33 of the socket body 30 defines a chamber 26 configured to receive a second end 24 of an adaptor 14. In one arrangement, the first end 33 of the socket body 30 is configured to receive and be coupled to the first end 22 of the adaptor 14. For example, the first end 33 can define an opening 36 configured to receive a fastening mechanism such as a portion of a ball detent assembly, a pin, or a position lock (not shown). When the second end 24 of the adaptor 14 is disposed within the chamber 26, insertion of the fastening mechanism within the opening 36 couples or secures the adaptor 14 to the impact socket 16. Such coupling minimizes loosening of the adaptor 14 relative to the impact socket 16, thereby minimizing inadvertent decoupling of the impact socket 16 relative to the impact wrench 12.

In one arrangement, the opening 36 is defined within a groove or channel 37 extending about a circumference of the first end 33 of the socket body 30. The groove 37 allows a user to dispose an O-ring at the first end 33 of the socket body 30 to cover the opening 36 and fastening mechanism to minimize introduction of contaminants into the chamber 26.

Figure 3:
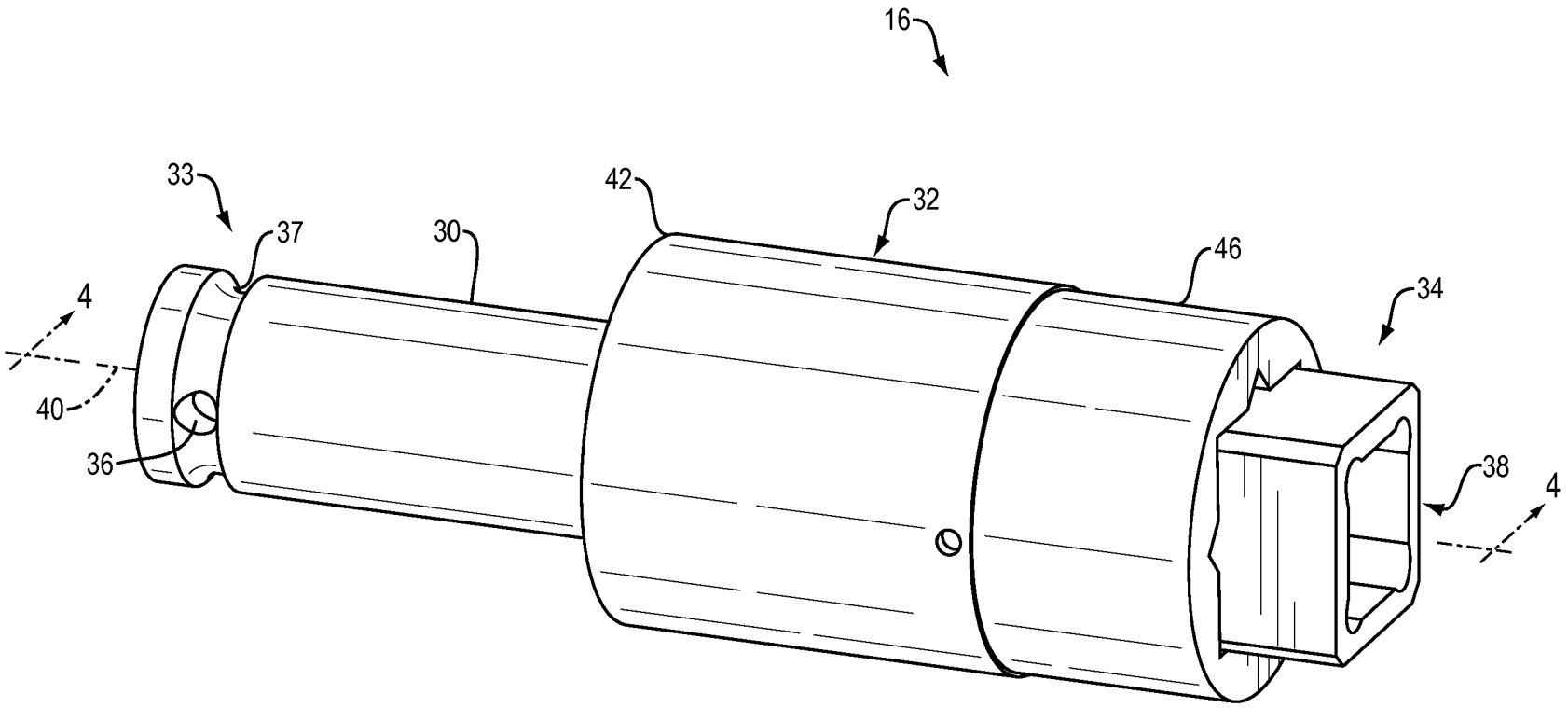
FIG. 3 illustrates the impact socket FIG. 2 having the collar assembly disposed in a second position along the longitudinal axis of the socket body, according to one arrangement.
Figure 4:
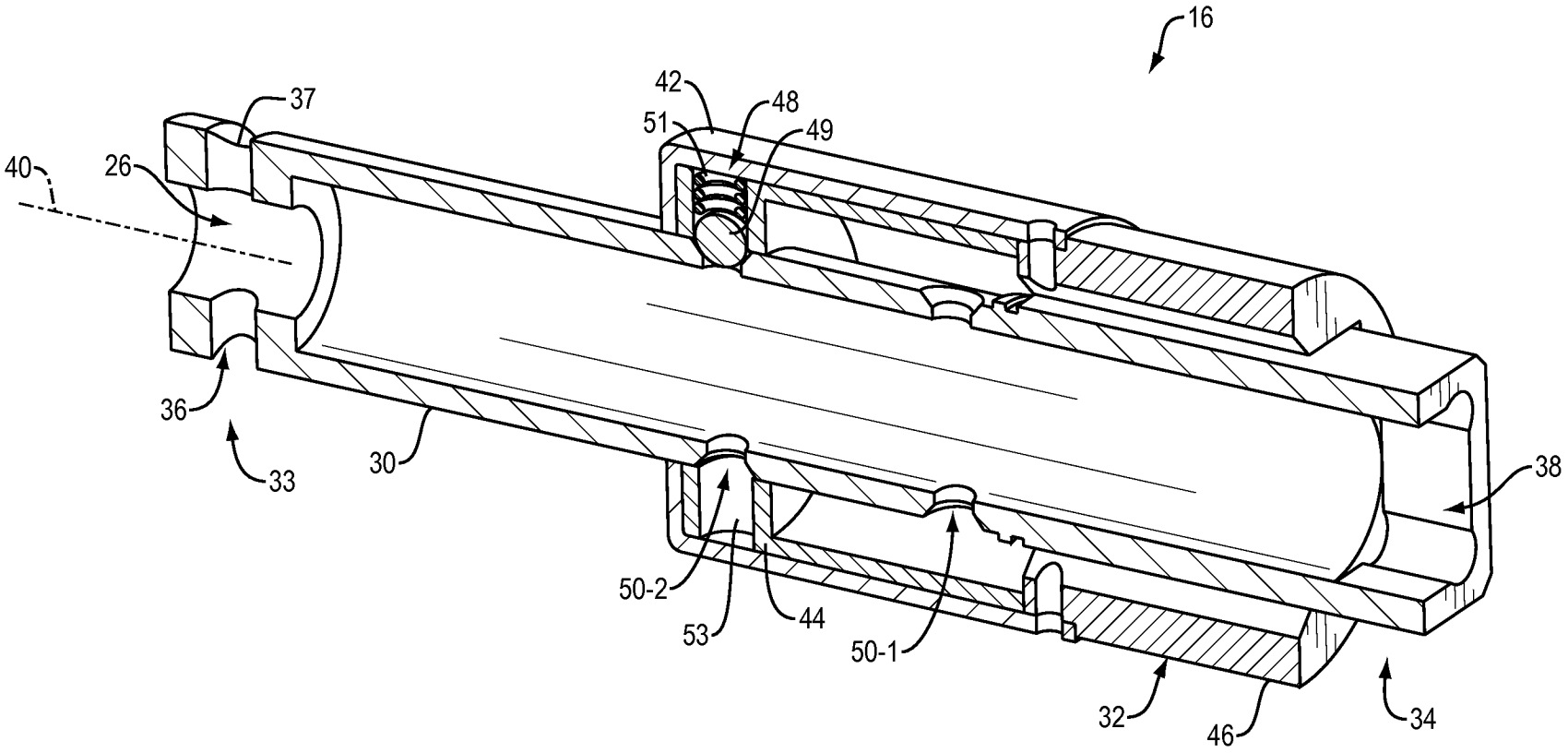
FIG. 4 illustrates a side sectional view of the impact socket shown in FIG. 3, according to one arrangement.

With particular reference to FIGS. 3 and 4, the socket body 30 defines at least one socket body fastener driving structure 38 at the opposing second end 34. While the body fastener driving structure 38 can be configured with a variety of geometries, in one arrangement and with reference to FIGS. 3-6, the socket body fastener driving structure 38 can be configured as a single, substantially square-shaped structure sized and shaped to receive a correspondingly sized and shaped fastener, such as a nut or bolt head. While the socket body fastener driving structure 38 can be configured in a variety of sizes, in one arrangement, the socket body fastener driving structure 38 is configured as having a ¾ inch square opening.

The collar assembly 32 is configured to translate longitudinally relative to a longitudinal axis 40 of the socket body 30. In one arrangement, the collar assembly 32 includes a securing mechanism 48 configured to selectively secure the collar assembly 32 to the socket body 30. For example, the securing mechanism can be configured as a ball 49 and spring mechanism 51 which selectively interfaces with detents 50 defined by the socket body 30, such as first detent 50-1 and second detent 50-2.

Figure 5A:
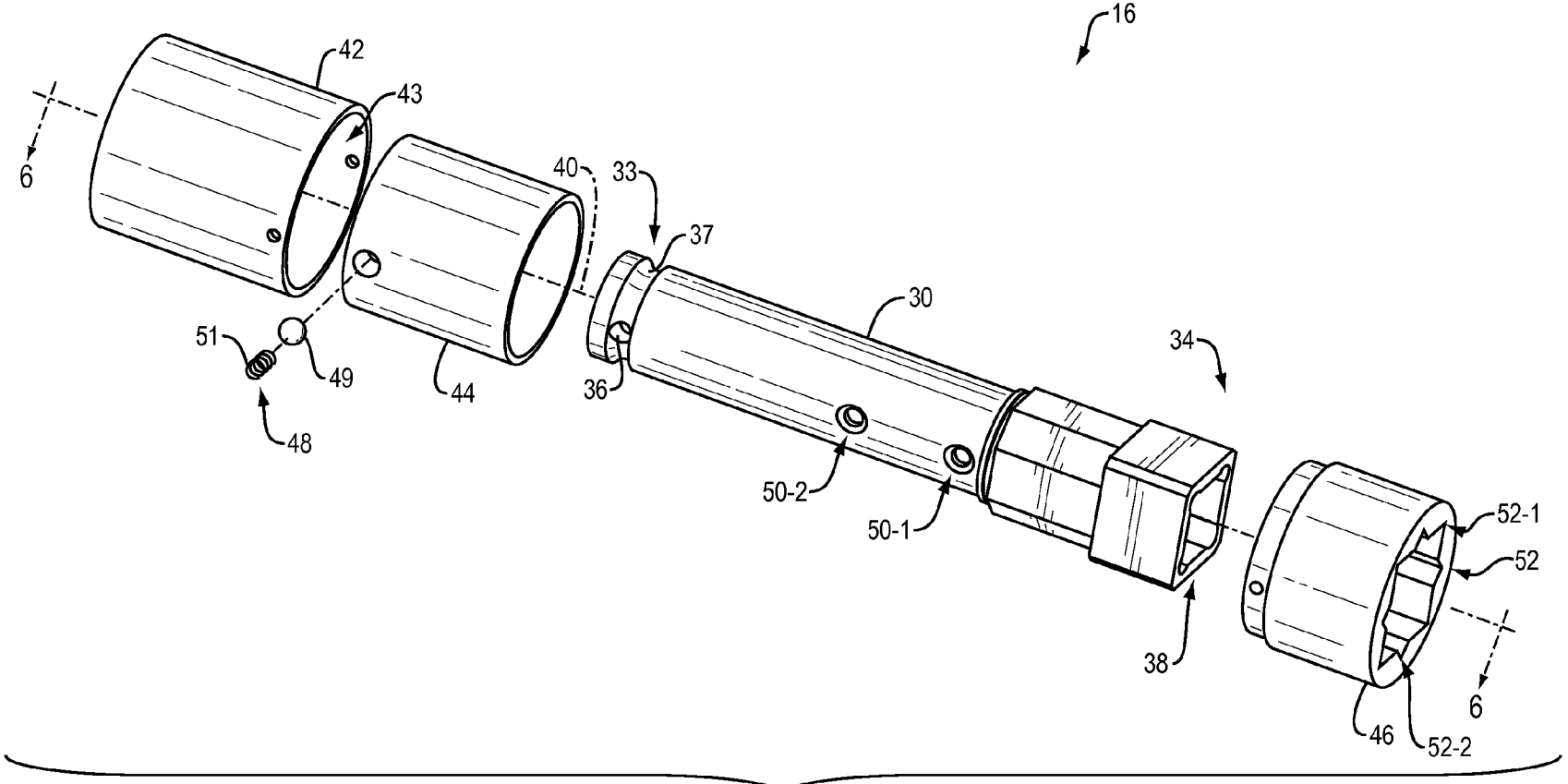
FIG. 5A illustrates an exploded view of the impact socket of FIG. 2, according to one arrangement.
Figure 5B:
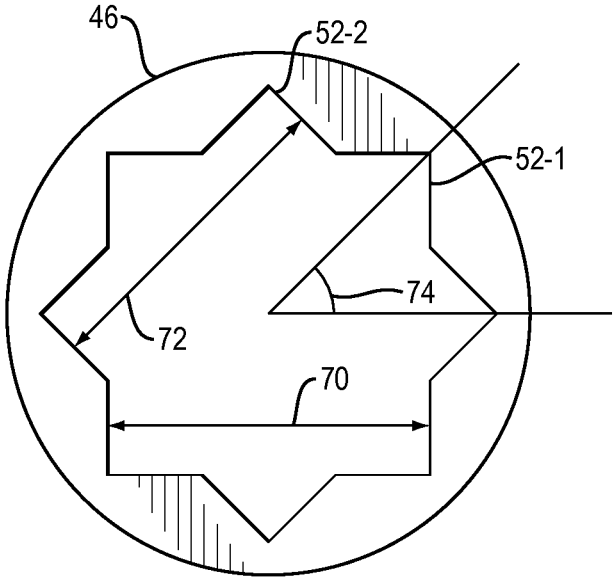
FIG. 5B illustrates a front end view of the impact socket of FIG. 2, according to one arrangement.
Figure 6:
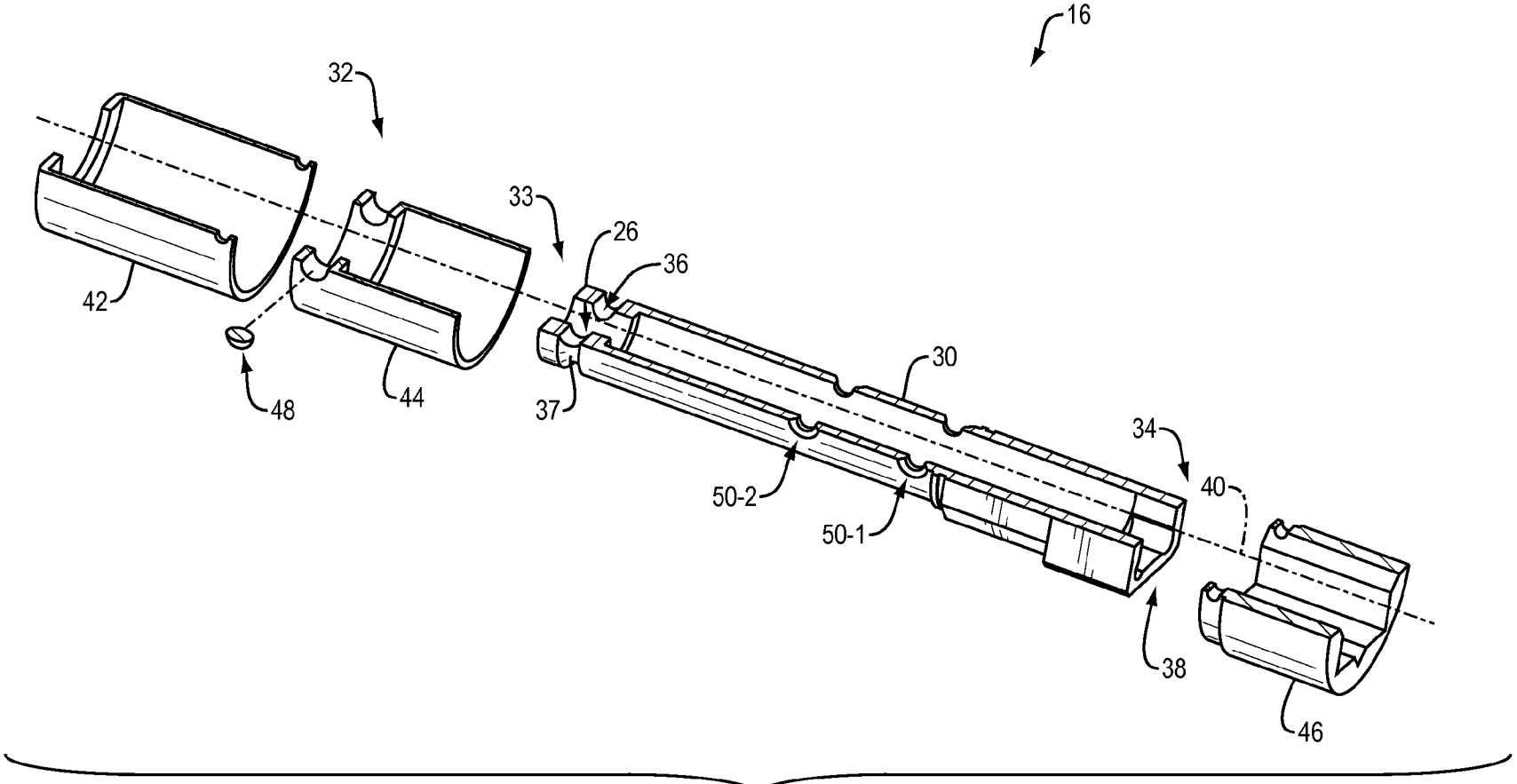
FIG. 6 illustrates a top sectional view of the impact socket illustrated in FIG. 5, according to one arrangement.

While the collar assembly 32 can be configured in a variety of ways, in one arrangement and with particular reference to FIGS. 4 through 6, the collar assembly 32 includes a base sleeve 42, a support sleeve 44, and a fastener driving sleeve 46.

In one arrangement, the base sleeve 42 and the support sleeve 44 are configured to maintain the positioning of the securing mechanism 48 relative to the socket body 30. For example, with reference to FIG. 4, the support sleeve 44 defines a chamber 53 which is configured, in part, to hold and constrain lateral movement of the ball 49 and spring mechanism 51 relative to the collar assembly 16. Additionally, as indicated in FIG. 5A, the support sleeve 44 is disposed within a chamber 43 defined by the base sleeve 42. Based upon the relative positioning of the support sleeve 44 and the base sleeve 42, the base sleeve 42 is configured as a cover for the chamber 53 to maintain the securing mechanism 48 therein.

The fastener driving sleeve 46 is coupled to the base sleeve 42 via a fastener and secures the support sleeve 44 within the chamber of the base sleeve 42. The fastener driving sleeve 46, in one arrangement, defines at least one collar assembly fastener driving structure 52 at its distal end. In one arrangement, with specific reference to FIGS. 2 and 5A, the fastener driving sleeve 46 defines two coaxially-aligned fastener driving structures, such as a first collar assembly fastener driving structure 52-1 and a second collar assembly fastener driving structure 52-2.

While the structures 52-1, 52-2 can be configured as a variety of different shapes, in one arrangement, each of the collar assembly fastener driving structures 52-1, 52-2 is defined as a substantially square-shaped structure that extends substantially along a length of the fastener driving sleeve 46. For example, each of the fastener driving structures 52-1, 52-2 defines four corners and four sides that extend along a length of the fastener driving sleeve 46, as indicated in FIG. 6. Accordingly, each of the fastener driving structures 52-1, 52-2 is configured to receive and substantially surround a correspondingly sized and shaped fastener, such as a nut or bolt head during operation.

The collar assembly fastener driving structures 52-1, 52-2 can be configured in a variety of sizes. With reference to FIG. 5B, in one arrangement, the first collar assembly fastener driving structure 52-1 is configured with a first opening size 70, such as a 1 inch square opening and the second collar assembly fastener driving structure 52-1 is configured with a second opening size 72 such as a 1⅛ inch square opening. Such a configuration allows an operator to adjust two differently sized fasteners at a worksite using a single fastener driving sleeve 46 without being required to remove and replace the impact socket 16 relative to the impact wrench 12.

In order to accommodate multiple fastener driving structures, the fastener driving sleeve 46 defines the first and second fastener driving structures 52-1, 52-1 as being rotationally offset from each other about the longitudinal axis 40 of the impact socket. For example, with continued reference to FIG. 5B, the fastener driving sleeve 46 defines the second fastener driving structure 52-2 as being rotationally offset by an angle 74 of about 45° relative to the first fastener driving structure 52-1.

Figure 2:
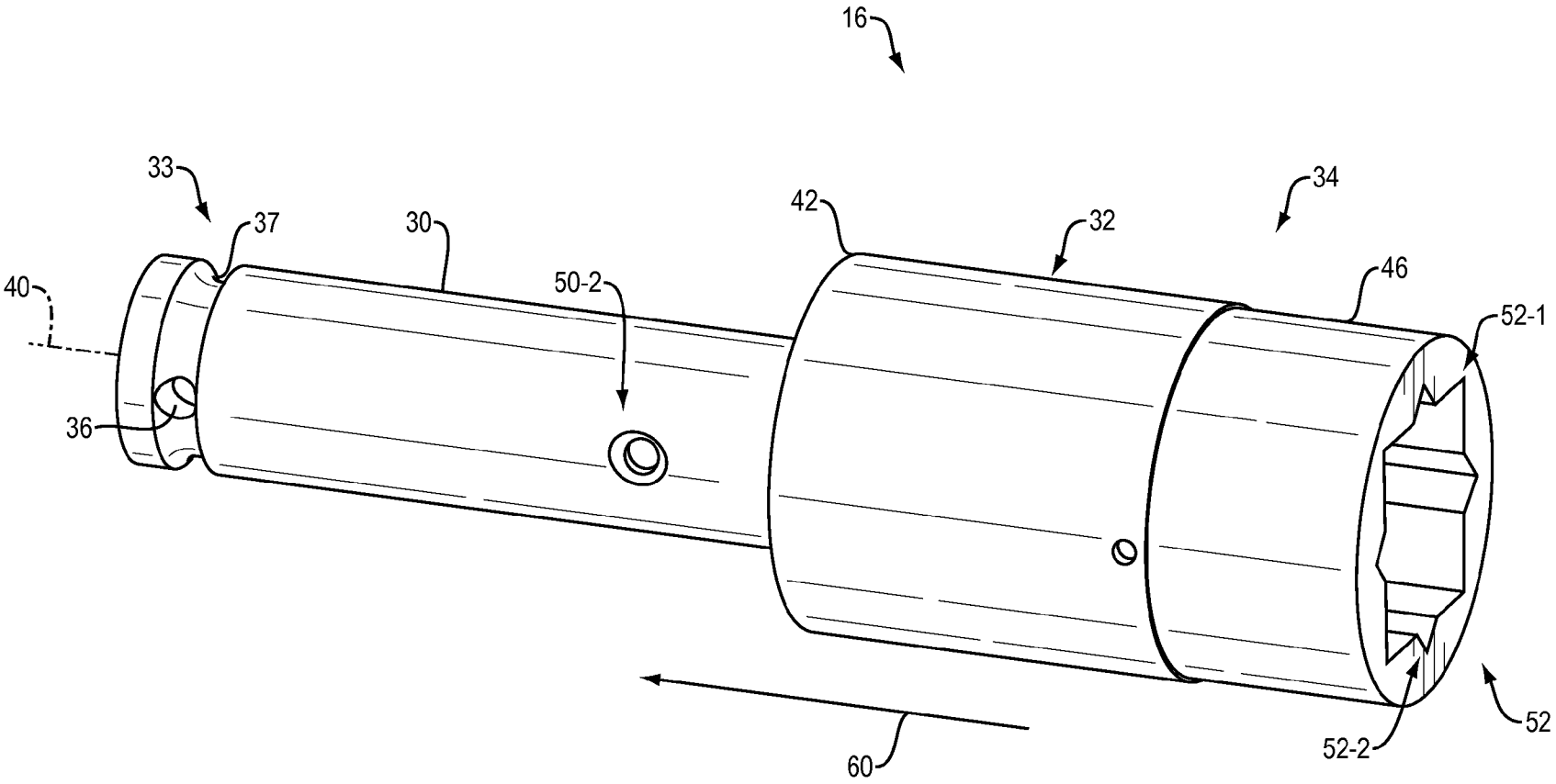
FIG. 2 illustrates a perspective view of an impact socket having a collar assembly disposed in a first position along a longitudinal axis of a socket body, according to one arrangement.

The collar assembly 32 is configured to move linearly between a first position, as shown in FIG. 2, and a second position, as shown in FIG. 3, relative to the socket body 30 of the impact socket 16 to provide a user with the distinctly-sized driving structures 38, 52 at a single end of the device 16. In one arrangement, in the first position, a portion of the fastener driving sleeve 46 can be at least equidistant to a distal or second end 34 of the socket body 30 to expose the first and second fastener driving structures 52-1, 52-1 for use. For example, with reference to FIG. 2, the securing mechanism 48 is disposed within the first detent 50-1 of the socket body 30 to secure the relative position of the collar assembly 32 to the socket body 30. In this position, a portion of the fastener driving sleeve 46 can extend beyond a distal end 34 of the socket body 30 such that a user can select one of the two coaxially-aligned fastener driving structures 52-1, 52-2 for driving a correspondingly sized nut or bolt head.

The user can translate the collar 32 along direction 60, as shown in FIG. 2, for a given distance, such as a distance of about 2 inches, to place the collar assembly 32 in the second position. For example, by applying a translation force to the collar 32 relative to the socket body 30, the translation force can overcome the spring force generated by the spring 51 on the ball 49 to extract the ball 49 from the first detent 50-1 and allow the securing mechanism 48 to translate along the socket body 30 to the second detent 50-2. In the second position, with reference to FIGS. 3 and 4, the securing mechanism 48 is disposed within the second detent 50-2 of the socket body 30 to secure the relative positioning of the collar assembly 32 to the socket body 30. In this position, the fastener driving sleeve 46 is disposed proximal to the distal end 34 of the socket body 30 which exposes the socket body fastener driving structure 38 for use such that the user can drive a correspondingly sized nut or bolt head.

While various embodiments of the innovation have been particularly shown and described, it will be understood by those skilled in the art that various changes in form and details may be made therein without departing from the spirit and scope of the innovation as defined by the appended claims.

For example, as indicated above, the impact socket 16 provides an operator with at least two distinctly sized fastener driving structures 38, 52, each of which defines an opening, such as a square opening. Such indication is by way of example only. In one arrangement, each fastener driving structure can define any opening shape, such as a hexagonally shaped opening, a pentagon shaped opening, or a custom spline shaped opening. Additionally, it should be noted that each of the fastener driving structures 38, 52 can have relatively different shaped openings. For example, the socket body fastener driving structure 38 can be configured with a pentagon shape and the collar assembly fastener driving structure 52 can be configured with a hexagonal shape. Alternately, for example, the socket body fastener driving structure 38 can be configured with a hexagonal shape and the collar assembly fastener driving structure 52 can be configured with a pentagon shape. Furthermore, in the case of the spline shaped opening, in one arrangement the socket body fastener driving structure 38 can be configured with a single spline that drives one or more nut or bolt head shapes (e.g., square and hexagonal shaped nuts) and the collar assembly fastener driving structure 52 can be configured with a single spline that drives one or more nut or bolt head shapes (e.g., square and hexagonal shaped nuts).

In another example, the collar assembly 32 is described as having two collar assembly fastener driving structures 52-1, 52-2. Such description is by way of example only. In one arrangement, the collar assembly 32 is configured with at least three collar assembly fastener driving structures.

In another example, the socket body 30 is described as defining a single socket body fastener driving structure 38. Such description is by way of example only. In one arrangement, the socket body 30 is configured with at least two socket body fastener driving structure 38.

Figure 8:
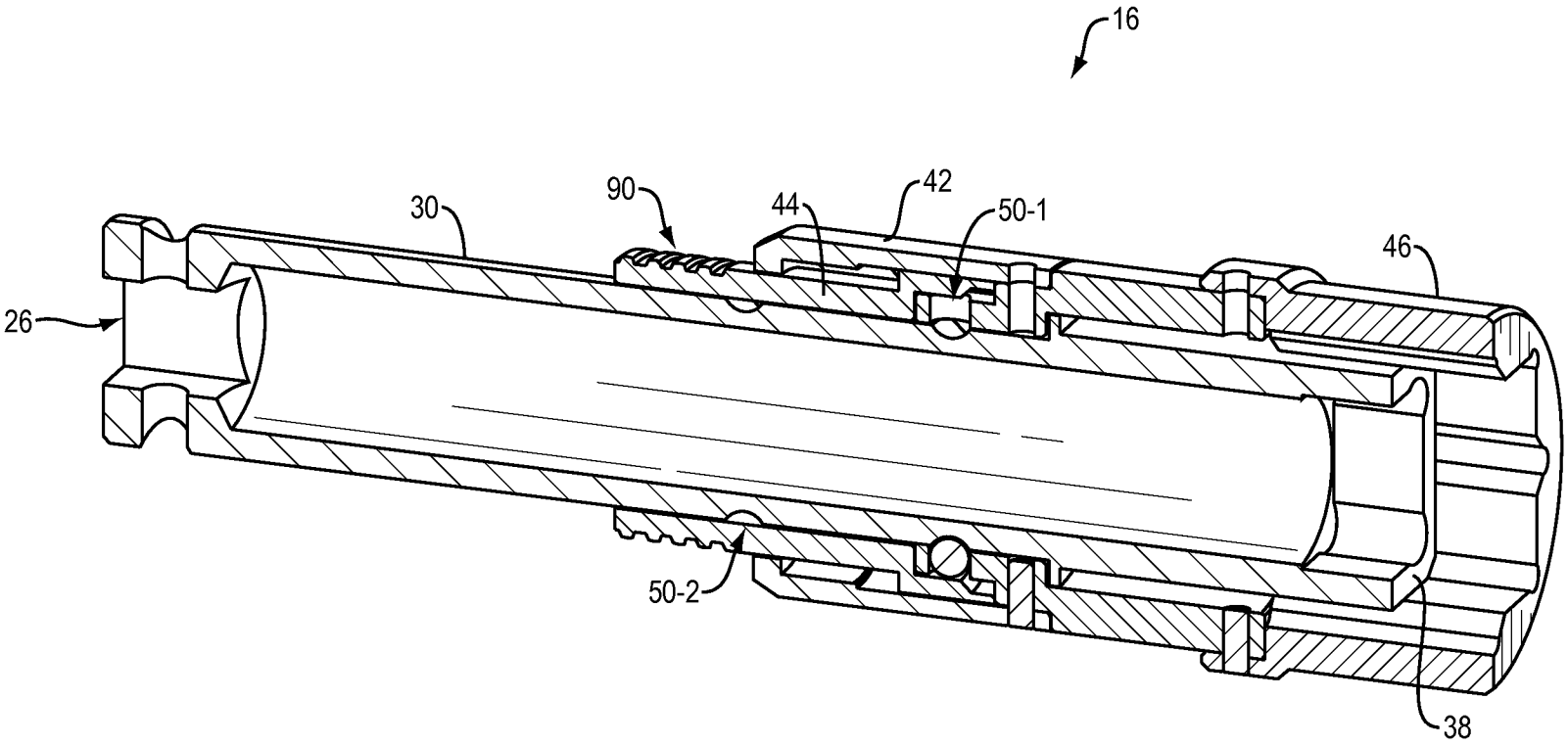
FIG. 8 illustrates a side sectional view of the impact socket shown in FIG. 7, according to one arrangement.

In another example, the first end 33 of the socket body 30 is described as defining a chamber 26 configured to receive a second end 24 of an adaptor 14. As indicated in FIG. 4, the chamber 26 is defined as a substantially cylindrically-shaped volume. Such illustration is by way of example only. In one arrangement, as indicated in FIG. 8, the chamber 26 is defined as a substantially rectangular volume. With such a configuration, the socket body can interface with the adaptor end 22, as illustrated in FIG. 1.

Figure 7:
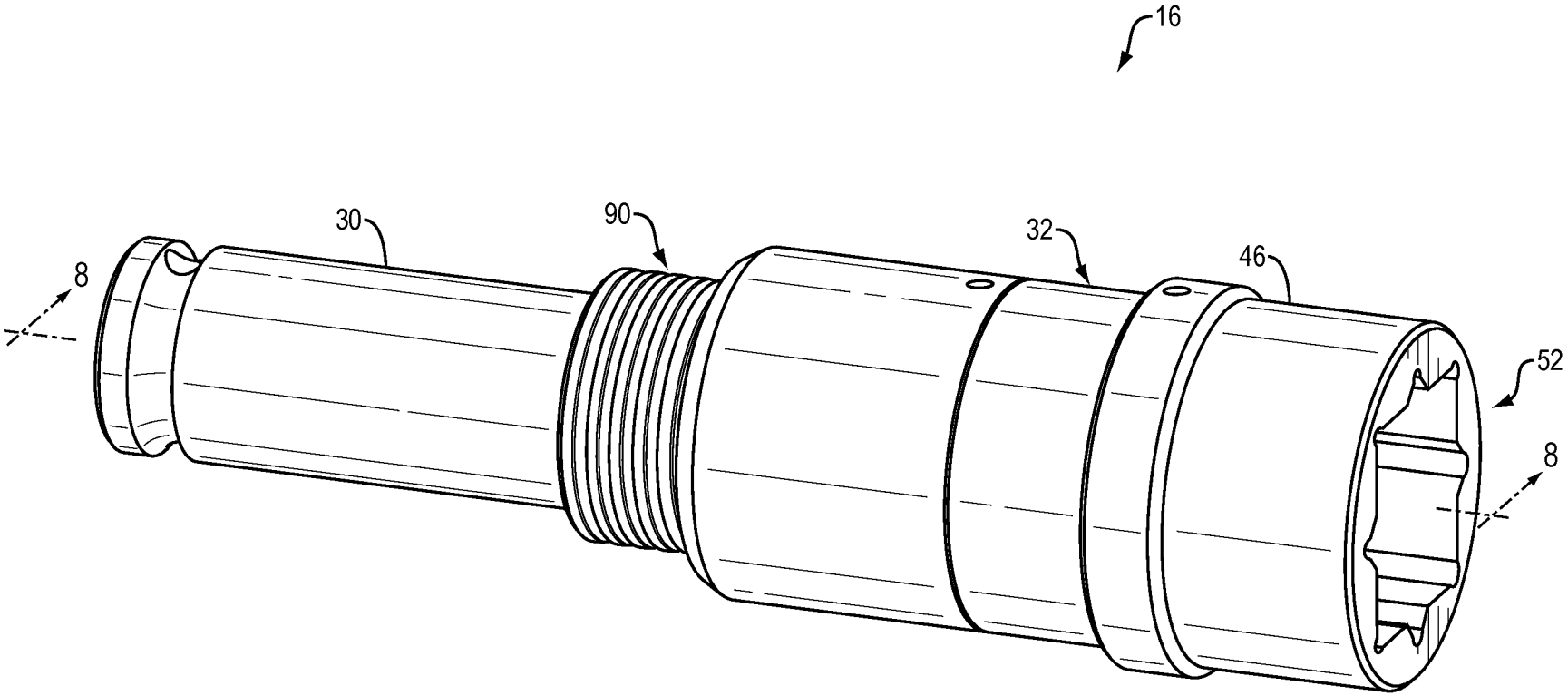
FIG. 7 illustrates a perspective view of an impact socket having a collar assembly disposed in a first position along a longitudinal axis of a socket body, according to one arrangement.

In another example, with reference to FIGS. 7 and 8, the collar assembly defines a set of ridges 90 disposed at least partly about an outer surface of the collar assembly 32. In one arrangement, the ridges provide an operator with a surface for grasping when positioning the collar assembly 32 relative to the socket body 30.

What is claimed is:

1. An impact socket, comprising:

a socket body having a first end configured to mount to a drive shaft of an impact wrench and an opposing second end, the socket body defining at least one socket body fastener driving structure at the second end;

a collar assembly carried by the socket body, the collar assembly defining at least one collar assembly fastener driving structure, the collar assembly being configured to move linearly between (i) a first position relative to the socket body where a distal end of the collar assembly extends beyond the second end of the socket body and (ii) a second position where the distal end of the collar assembly is disposed at least equidistant to the second end of the socket body; and a securing mechanism carried by the collar assembly, the securing mechanism configured (i) to secure the collar assembly to the socket body when the collar assembly is disposed in the first position and (ii) to secure the collar assembly to the socket body when the collar assembly is disposed in the second position;

wherein the collar assembly comprises a support sleeve defining a chamber configured to constrain lateral movement of the securing mechanism relative to the collar assembly, and a base sleeve defining a chamber, the support sleeve disposed within the chamber defined by the base sleeve and the base sleeve configured to maintain the securing mechanism within the chamber defined by the support sleeve.

2. The impact socket of claim 1, wherein, in the second position, the distal end of the collar assembly is disposed proximal to the second end of the socket body.

3. The impact socket of claim 1, wherein the at least one socket body fastener driving structure defines a substantially square opening that extends along a longitudinal axis of the at least one socket body fastener driving structure.

4. The impact socket of claim 1, wherein the collar assembly defining the at least one collar assembly fastener driving structure comprises a fastener driving sleeve that defines a first fastener driving structure and a second fastener driving structure, the first fastener driving structure configured to drive a first sized fastener and the second fastener driving structure configured to drive a second sized fastener, the first sized fastener being distinct from the second sized fastener.

5. The impact socket of claim 4, wherein the fastener driving sleeve defines the first fastener driving structure at a rotational offset relative to the second fastener driving structure.

6. The impact socket of claim 1, wherein:

the securing mechanism comprises a ball and spring mechanism; and the collar assembly defines a first detent and a second detent, the ball and spring mechanism configured to engage the first detent when the collar assembly is disposed in the first position and to engage the second detent when the collar assembly is disposed in the second position.

7. The impact socket of claim 1, wherein the collar assembly defines a set of ridges disposed at least partly about an outer surface of the collar assembly.

8. An impact socket, comprising:

a socket body having a first end configured to mount to a drive shaft of an impact wrench and an opposing second end, the socket body defining at least one socket body fastener driving structure at the second end;

a collar assembly carried by the socket body, the collar assembly defining at least one collar assembly fastener driving structure, the collar assembly configured to be selectively secured to the socket body at (i) a first position relative to the socket body where a distal end of the collar assembly extends beyond the second end of the socket body and (ii) a second position where the distal end of the collar assembly is disposed at least equidistant to the second end of the socket body; and a securing mechanism carried by the collar assembly, the securing mechanism configured to (i) selectively secure the collar assembly to the socket body when the collar assembly is disposed in the first position and (ii) selectively secure the collar assembly to the socket body when the collar assembly is disposed in the second position;

wherein the collar assembly comprises:

a support sleeve defining a chamber configured to constrain lateral movement of the securing mechanism relative to the collar assembly, and a base sleeve defining a chamber, the support sleeve disposed within the chamber defined by the base sleeve and the base sleeve configured to maintain the securing mechanism within the chamber defined by the support sleeve.

9. The impact socket of claim 8, wherein, in the second position, the distal end of the collar assembly is disposed proximal to the second end of the socket body.

10. The impact socket of claim 8, wherein the at least one socket body fastener driving structure defines a substantially square opening that extends along a longitudinal axis of the at least one socket body fastener driving structure.

11. The impact socket of claim 8, wherein the collar assembly defining the at least one collar assembly fastener driving structure comprises a fastener driving sleeve that defines a first fastener driving structure and a second fastener driving structure, the first fastener driving structure configured to drive a first sized fastener and the second fastener driving structure configured to drive a second sized fastener, the first sized fastener being distinct from the second sized fastener.

12. The impact socket of claim 11, wherein the fastener driving sleeve defines the first fastener driving structure at a rotational offset relative to the second fastener driving structure.

13. The impact socket of claim 8, wherein:

the securing mechanism comprises a ball and spring mechanism; and the collar assembly defines a first detent and a second detent, the ball and spring mechanism configured to engage the first detent when the collar assembly is disposed in the first position and to engage the second detent when the collar assembly is disposed in the second position.

14. The impact socket of claim 8, wherein the collar assembly defines a set of ridges disposed at least partly about an outer surface of the collar assembly.

* * * * *